US005959584A

United States Patent [19]

Gorham et al.

[11] Patent Number: 5,959,584

[45] Date of Patent: Sep. 28, 1999

[54] VEHICLE COMMUNICATIONS SYSTEM

[75] Inventors: Kenneth Duane Gorham, Palatine; Warren E. Guthrie, Wheaton; Roger Brunner Williams, Lake Zurich, all of Ill.

[73] Assignee: Northrop Grumman Corporation, Los Angeles, Calif.

[21] Appl. No.: 08/844,426

[22] Filed: Apr. 18, 1997

[51] Int. Cl.[6] ..... H01Q 1/32

[52] U.S. Cl. ..... 343/711; 343/713; 343/717

[58] Field of Search ..... 343/711, 712, 343/713, 767, 768, 771, 717, 841, 853; 342/357, 353, 385; 455/7

[56] References Cited

U.S. PATENT DOCUMENTS

| | | | |
|---|---|---|---|
| 3,004,153 | 10/1961 | Alford | 250/13 |
| 3,772,691 | 11/1973 | Hansen | 343/6.5 SS |
| 4,298,875 | 11/1981 | Sullivan | 343/112 CA |
| 4,823,142 | 4/1989 | Ohe et al. | 343/713 |
| 4,845,506 | 7/1989 | Shibata et al. | 343/713 |
| 4,887,089 | 12/1989 | Shibata et al. | 343/700 |
| 4,902,948 | 2/1990 | Sherman et al. | 318/580 |
| 4,958,167 | 9/1990 | Schroeder | 343/853 |
| 4,968,984 | 11/1990 | Katoh et al. | 343/713 |
| 5,008,682 | 4/1991 | Blaese | 343/713 |
| 5,177,494 | 1/1993 | Dorrie et al. | 343/711 |
| 5,583,513 | 12/1996 | Cohen | 342/357 |

*Primary Examiner*—Frank G. Font
*Assistant Examiner*—Layla Lauchman
*Attorney, Agent, or Firm*—Terry J. Anderson; Karl J. Hoch, Jr.

[57] ABSTRACT

A vehicle having a plurality of antennas each in association with a communications transmitter device disposed within the vehicle to thereby provide multiple signal transmission sites. At least one antenna is disposed substantially at a top site of the vehicle and at least one antenna is disposed substantially at a bottom site of the vehicle, thus providing antenna coverage irrespective of the spatial orientation of the vehicle. The invention includes a communications system employing a multiplicity of antenna sites as well as methodology for providing a communication link from a vehicle to a receiving site by incorporating the communications system. In this manner, vehicle occupants are provided with a communications link from the vehicle, irrespective of the position of the vehicle. Thus, if one antenna is shielded from transmission because it is situated at a top site of a vehicle and the vehicle is upside down because of a mishap, another antenna which is situated to be operable from a non-shielded site (e.g. a bottom site of the vehicle) will provide effective signal transmission. The invention thereby provides enhanced safety and security for vehicle occupants in most travel environments.

15 Claims, 1 Drawing Sheet

VEHICLE COMMUNICATIONS SYSTEM

FIELD OF THE INVENTION

This invention relates in general to mobile communications, and in particular to a vehicle and a vehicle communications system wherein at least one antenna is disposed substantially at a top site of the vehicle and at least one antenna is disposed substantially at a bottom site of the vehicle to thereby assure a communication link from the vehicle irrespective of the physical orientation of the vehicle.

BACKGROUND OF THE INVENTION

Driver and passenger safety on highways, rural roads, urban streets, and the like is of great concern as more and more people are present in automobiles, trucks, buses, and other vehicles. Statistically, a certain number of mishaps occur over any given time period, and most of these mishaps require summoning law enforcement and/or medical personnel to the site of a crash, collision, or other misfortune. While travel in heavily populated areas or on heavily used thoroughfares generally assures the presence of assistance in calling for help, such is not necessarily the case when travel is in more desolate regions. For this reason many people have radio communications devices in their vehicles so that assistance can be summoned.

Communications devices require an antenna linkage for broadcasting and an antenna placement that provides signal transmission. Therefore, if an antenna is not properly placed or is shielded, no transmission can occur. An example of such an event would be found in a typical automobile having a top surface with an antenna mounted thereon. If that automobile rolls over and comes to rest on its top, its antenna would be shielded from a transmission site and no signal could be generated from the disabled vehicle. It is obvious that such an event could be very serious or fatal for an occupant of the vehicle who is injured and who cannot call for help because a transmitting antenna is blocked between the top surface of the rolled-over car and the ground.

In view of the potential seriousness of inadequate transmittability of messages from a vehicle because of an untoward orientation of an antenna associated with the vehicle, it is apparent that a need is present for proper antenna presence at the vehicle. Accordingly, a primary object of the present invention is to provide a vehicle with a communications transmitter device from which transmissions can occur irrespective of the spatial orientation of the vehicle.

Another object of the present invention is to provide a vehicle having an antenna disposed at a top site thereof and another disposed at a bottom site thereof, such that an overturned orientation will not disrupt signal transmission.

Yet another object of the present invention is to provide a vehicle communication system having a plurality of antennas each in association with a communications transmitter device within the vehicle.

These and other objects of the present invention will become apparent throughout the description of the invention which now follows.

SUMMARY OF THE INVENTION

The present invention is a vehicle having a plurality of antennas each in association with a communications transmitter device disposed within the vehicle to thereby provide multiple signal transmission sites. At least one antenna is disposed substantially at a top site of the vehicle and at least one antenna is disposed substantially at a bottom site of the vehicle, thus providing antenna coverage irrespective of the spatial orientation of the vehicle. The invention includes a communications system employing a multiplicity of antenna sites as well as methodology for providing a communication link from a vehicle to a receiving site by incorporating the communications system. In this manner, vehicle occupants are provided with a communications link from the vehicle, irrespective of the position of the vehicle. Thus, if one antenna is shielded from transmission because, for example, it is situated at the top of the vehicle and the vehicle is upside down because of an accident, another antenna which is situated to be operable from a non-shielded site will provide effective signal transmission. The invention thereby provides enhanced safety and security for vehicle occupants in most travel environments.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENTS

Figure 1:
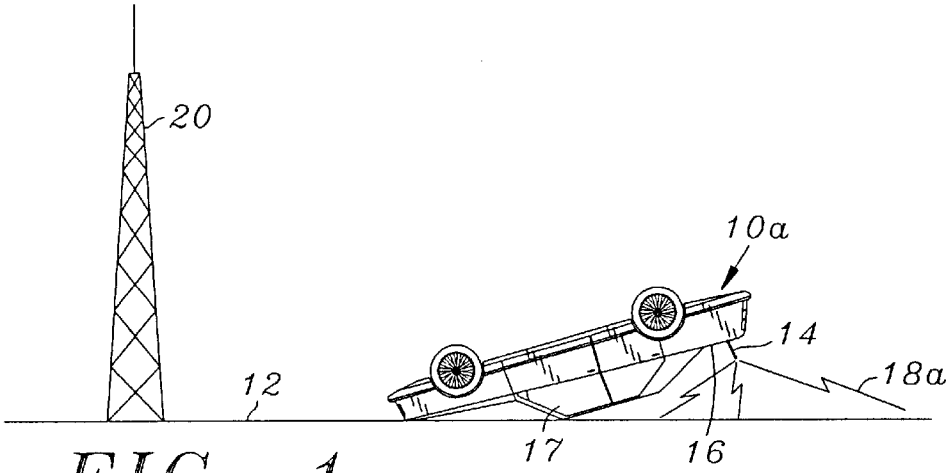
FIG. 1 is an illustration of an overturned automobile having an antenna situated at its top surface.

Referring to FIG. 1, an automobile 10*a* is situated upside down on the ground 12. The automobile 10*a* has an antenna 14 conventionally mounted on its top surface 16 and in association with a radio frequency transmitter (not shown) disposed within the interior 17 of the automobile 10*a*. As is illustrated, a radio signal represented by wave lines 18*a* is being generated, but the antenna 14 is shielded between the ground 12 and the top surface 16. Consequently, because of the spatial orientation of the automobile 10*a*, the radio signal 18*a* cannot reach a receiver tower 20 for ultimate transmission to a designated recipient.

Figure 2:
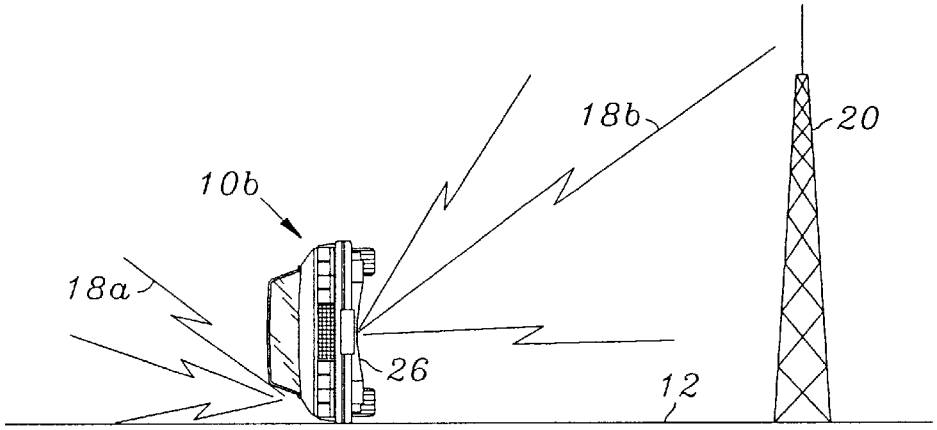
FIG. 2 is an illustration of an automobile on its side and having an antenna situated at its top surface and an antenna situated at its bottom.
Figure 3:
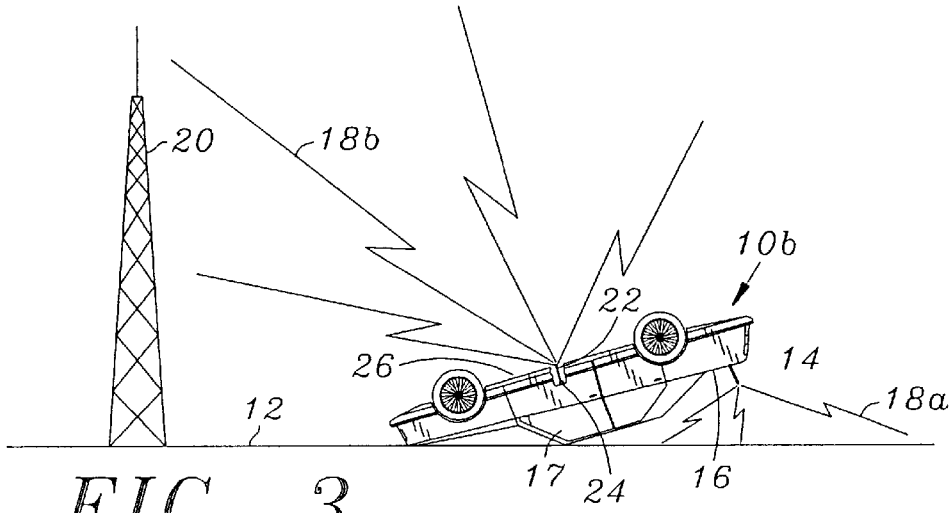
FIG. 3 is an illustration of an overturned vehicle, partially broken away, having an antenna situated at its top surface and an antenna situated at its bottom.

An automobile 10*b* is illustrated in FIGS. 2 and 3. This automobile 10*b* has a first antenna 14 conventionally mounted on its top surface 16 and in association with a radio frequency transmitter (not shown) disposed within the interior 17 of the automobile 10*b*, all as in the automobile 10*a* of FIG. 1. Additionally, the automobile 10*b* has a second antenna 22 conventionally mounted to a frame member 24 of its undersurface 26 and likewise in association with the radio frequency transmitter disposed within the interior 17. As a result, radio signals, illustrated by wave lines 18*a* and 18*b*, are generated from both antennas 14, 22. If the automobile 10*b* comes to rest on its side, as illustrated in FIG. 2, transmission from the antenna 14 is blocked by the automobile body from reaching the base station tower 20. However, transmission from the antenna 22 is not blocked by the automobile body and can reach the base station tower 20. However, if the automobile 10*b* comes to rest upside down, as shown in FIG. 3, transmission from the antenna 14, situated on the top surface 16, is shielded. As a result, the antenna 22 is the only antenna capable of transmitting a signal to summon help. By minimally having two antennas 14, 22, respectively mounted at a top site and a bottom site of an automobile 10*b*, substantially all spatial orientations of the automobile 10*b* resulting from an accident, collision, or the like will not prohibit effective signal transmission from at least one of the two antennas 14, 22.

As is apparent, the present invention can provide valuable "Mayday" monitoring, protection and support for drivers and passengers of vehicles. Although envisioned to be primarily of value in vehicle mishaps caused by driving, the present invention can also provide safety and security in military combat situations, law enforcement activities, and other circumstances where continual communication linkage is desirable. While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A vehicle communication system comprising:

a) a land vehicle;

b) a sole single-frequency radio signal transmitter device situated within the vehicle;

c) a plurality of antennas each in association with the communications transmitter device, wherein at least one antenna is disposed substantially at a top site of the vehicle and at least one antenna is disposed substantially at a bottom site of the vehicle.

2. A vehicle communication system as claimed in claim 1 wherein said vehicle has a top surface and the antenna disposed substantially at the top site of the vehicle is mounted to the top surface thereof.

3. A vehicle communication system as claimed in claim 2 wherein said vehicle has a frame member accessible from beneath the vehicle and the antenna disposed substantially at the bottom site of the vehicle is mounted to the frame member.

4. A vehicle communication system as claimed in claim 1 wherein said vehicle has a frame member accessible from beneath the vehicle and the antenna disposed substantially at the bottom site of the vehicle is mounted to the frame member.

5. A land vehicle having a plurality of antennas each in association with a sole single-frequency radio signal transmitter device disposed within the vehicle, wherein at least one antenna is disposed substantially at a top site of the vehicle and at least one antenna is disposed substantially at a bottom site of the vehicle.

6. A vehicle as claimed in claim 5 wherein said vehicle has a top surface and the antenna disposed substantially at the top site of the vehicle is mounted to the top surface thereof.

7. A vehicle as claimed in claim 6 wherein said vehicle has a frame member accessible from beneath the vehicle and the antenna disposed substantially at the bottom site of the vehicle is mounted to the frame member.

8. A vehicle as claimed in claim 5 wherein said vehicle has a frame member accessible from beneath the vehicle and the antenna disposed substantially at the bottom site of the vehicle is mounted to the frame member.

9. A land vehicle having a plurality of antennas each connectable to a sole single-frequency radio signal transmitter device, wherein at least one antenna is disposed substantially at a top site of the vehicle and at least one antenna is disposed substantially at a bottom site of the vehicle.

10. A vehicle as claimed in claim 9 wherein said vehicle has a top surface and the antenna disposed substantially at the top site of the vehicle is mounted on the top surface thereof.

11. A vehicle as claimed in claim 10 wherein said vehicle has a frame member accessible from beneath the vehicle and the antenna disposed substantially at the bottom site of the vehicle is mounted to the frame member.

12. A method for providing a communication link from a vehicle to a receiving site, the method comprising:

a) providing a land vehicle;

b) providing a sole single-frequency radio signal transmitter device within the vehicle;

c) providing to the vehicle a plurality of antennas each in association with the communications transmitter device; and d) mounting at least one said antenna substantially at a top site of the vehicle and at least one said antenna substantially at a bottom site of the vehicle.

13. A method as claimed in claim 12 wherein said vehicle has a top surface and the antenna disposed substantially at the top site of the vehicle is mounted to the top surface thereof.

14. A method as claimed in claim 13 wherein said vehicle has a frame member accessible from beneath the vehicle and the antenna disposed substantially at the bottom site of the vehicle is mounted to the frame member.

15. A method as claimed in claim 12 wherein said vehicle has a frame member accessible from beneath the vehicle and the antenna disposed substantially at the bottom site of the vehicle is mounted to the frame member.

* * * * *